United States Patent [19]

Lee

[11] Patent Number: 4,577,544

[45] Date of Patent: Mar. 25, 1986

[54] ULTRAFAST THERMAL ACTUATOR

[75] Inventor: John T. M. Lee, Phoenixville, Pa.

[73] Assignee: ICI Americas Inc., Wilmington, Del.

[21] Appl. No.: 609,632

[22] Filed: May 14, 1984

[51] Int. Cl.[4] ..... F42C 19/00; A62C 37/08; A62C 35/02

[52] U.S. Cl. ..... 89/1.14; 169/28; 169/42

[58] Field of Search ..... 89/1.14; 169/42, 28, 169/37, 38

[56] References Cited

U.S. PATENT DOCUMENTS

| | | | |
|---|---|---|---|
| 2,324,428 | 7/1943 | Roessner | 169/42 |
| 2,526,159 | 10/1950 | Rowley | 169/42 X |
| 2,822,877 | 2/1958 | Post | 169/28 |
| 3,314,482 | 4/1967 | Young | 169/38 |
| 3,547,201 | 12/1970 | Balmes | 169/42 X |
| 3,597,604 | 8/1971 | Shaffer | 431/92 X |
| 3,619,927 | 11/1971 | Robinet | 89/1.14 X |
| 3,831,682 | 8/1974 | Cakaro | 169/42 X |
| 3,897,828 | 8/1975 | Glower | 169/43 |
| 3,948,143 | 4/1976 | Olsen | 89/1.14 |
| 3,971,322 | 7/1976 | Olsen | 89/1.14 X |
| 4,102,482 | 7/1978 | Roegsegger | 228/170 |
| 4,188,856 | 2/1980 | Bendler et al. | 89/1.14 |

FOREIGN PATENT DOCUMENTS

| | | |
|---|---|---|
| 418110 | 10/1934 | United Kingdom . |
| 489830 | 12/1937 | United Kingdom . |
| 647867 | 12/1950 | United Kingdom . |
| 828939 | 2/1960 | United Kingdom . |
| 2049415 | 12/1980 | United Kingdom . |

OTHER PUBLICATIONS

"Fire Protection Handbook", 15th Ed., 1981, G. P. Kinnon, Natl. Fire Prevention Assoc., pp. 17–32 to 17–35.

"Novel Explosive Release Technique", J. T. M. Lee, 1981 Annual Meet. Pyrotechics & Explosives Appl. Sect., Nov. 1981.

Early Suppression–Fast Response: A Revolution in Sprinkler Technology in "Fire Journal" pp. 42–46, Jan. 1984.

*Primary Examiner*—David H. Brown

*Attorney, Agent, or Firm*—Richard A. Rowe

[57] ABSTRACT

Fast acting actuation system which is especially suitable for automatic sprinklers and other emergency devices. The system includes a fast-acting low mass thermally responsive element comprising a pair of thin metal strips soldered together, a percussion member such as a firing pin which is released when the solder in the thermally responsive element melts, and an actuator, preferably a radially expandable explosive actuator, which is initiated by the firing pin. The actuator when initiated causes rapid actuation of the automatic sprinkler or other device.

3 Claims, 11 Drawing Figures

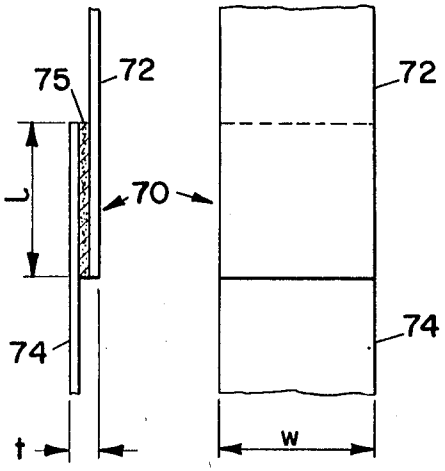
FIG. 2A
FIG. 1A
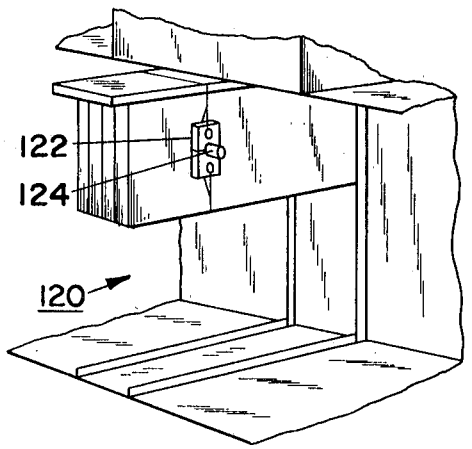
FIG. 9
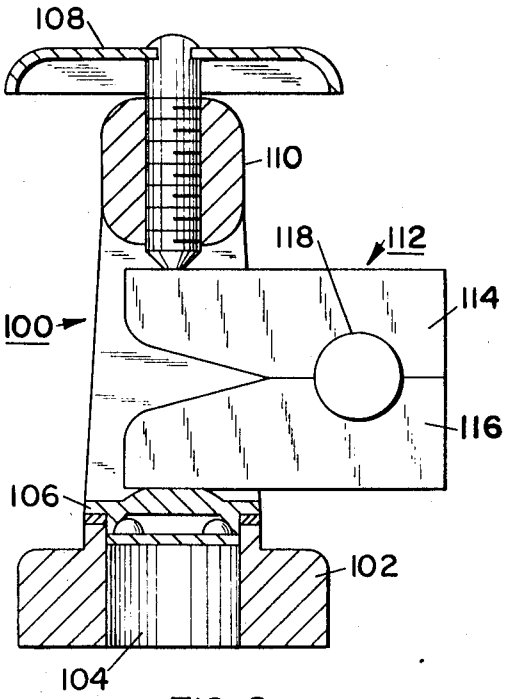
FIG. 8
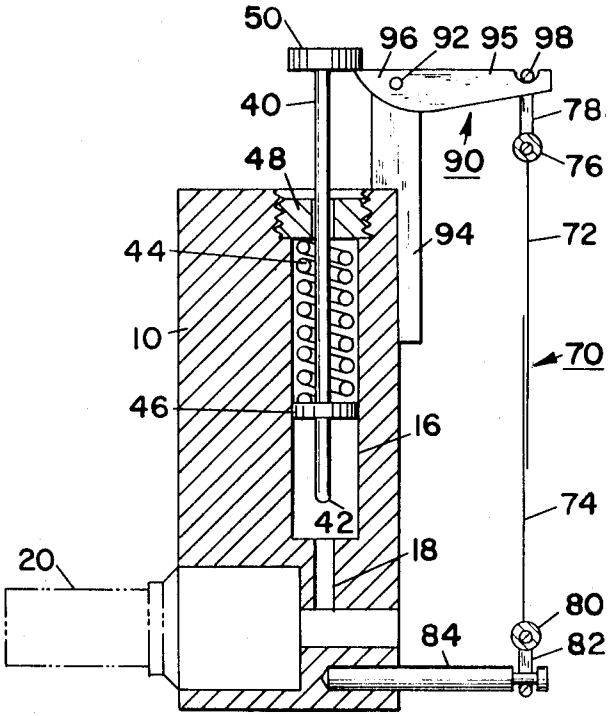
FIG. 7

ULTRAFAST THERMAL ACTUATOR

BACKGROUND OF THE INVENTION

1. Field of the Invention

This invention relates to actuation systems which are suitable for actuation of automatic sprinklers and other emergency devices. More particularly, this invention relates to an ultrafast acting thermally initiated actuation system, or, more simply, an ultrafast thermal actuator.

2. Description of the Prior Art

Automatic sprinklers employing a fusible element have enjoyed widespread commercial success for years. Devices of this type are shown, for example, in "Fire Protection Handbook," 15th edition, 1981, G. P. Kinnon, ed., Boston, National Fire Protection Association, pages 17–32 to 17–35, and in U.S. Pat. No. 3,314,482 to Young. Typically such an automatic sprinkler includes a discharge valve which is normally held shut by a mechanism which is directly connected to the fusible material. When a predetermined temperature is reached, the fusible material melts, releasing the link and lever mechanism and allowing the discharge valve to open. The fusible material may take various forms, e.g., a solder pellet or a link which includes a mass of fusible material. Sprinklers employing a link of this type are commonly referred link and lever type sprinklers. "Fire Protection Handbook" cited supra illustrates several link and lever type sprinklers. FIG. 17-3G (page 17–33) of "Fire Protection Handbook" illustrates a representative link and lever sprinkler comprising two levers which hold the sprinkler's discharge valve shut, and a link which includes a pair of metal members which are soldered together. The link is directly connected to the levers so that the levers hold the discharge valve closed under normal conditions. When the melting point of the solder is exceeded, the solder melts and the two link members separate, allowing the discharge valve to open.

Automatic sprinklers of the type described above have been useful primarily only for the control of fires rather than their suppression. According to Cheng Yao et al., *Fire Journal,* Jan. 1984, pages 42 to 46, the reason that such sprinklers are useful only for control rather than suppression of fires is their slow response time. This in turn is due to the large mass of the fusible link. As Yao et al. point out, faster response can be obtained by reducing the mass of the fusible link. Yao et al. on page 44 illustrate two fusible link type automatic sprinklers of similar structure except that the fast response sprinkler has a lower mass fusible link. The slower response sprinkler illustrated is similar to that shown in FIG. 17-3G (page 17–33) of "Fire Protection Handbook" cited supra. A convenient measure of thermal element sensitivity in sprinklers of this type is "response time index", or RTI, according to Yao et al. The more responsive the element is to temperature change, the lower its RTI value.

An automatic sprinkler of the type described above must be strong enough so that it will not rupture in its static or ready condition. Specifically, the fusible link must be strong enough to withstand the forces placed upon it and the lever mechanism by the high pressure water in the sprinkler. If the fusible link is made too thin, it cannot withstand these forces.

Also known are fire extinguisher actuation systems in which a thermally responsive member triggers a firing pin, which in turn initiates an explosive device which causes the fire extinguisher to open. U.S. Pat. No. 2,822,877 to Post, and U.S. Pat. No. 4,188,856 to Bendler et al., illustrate two such devices. No device of this type has achieved a degree of success even approaching that achieved by the fusible link type automatic sprinklers such as those shown in "Fire Protection Handbook" cited supra.

Reduction of the fusible link mass in conventional fusible link automatic sprinklers, as illustrated in Yao et al. cited supra, has probably gone as about as far as it can go. Further reduction of the fusible link mass would likely weaken the fusible link to the point that it could no longer be depended on to hold the link and the lever mechanism in place against the force of water under pressure under normal service conditions. Other types of automatic sprinklers have not found widespread acceptance. There exists a need for a new approach which will make possible a rugged and yet at the same time very fast-acting actuation system which can be used on automatic sprinklers.

SUMMARY OF THE INVENTION

The present invention provides a fast-actuation system comprising a percussion-initiated actuator, a normally retracted percussion member which when released initiates the actuator, and a thermally responsive tension member comprising a pair of overlapping thin strips joined together by a thin layer of fusible material, for controlling the release of the percussion member.

The actuation system of this invention is particularly useful for actuation of automatic sprinklers and other emergency devices.

BRIEF OF DESCRIPTION OF THE DRAWINGS

In the drawings:

FIG. 1A is a front sectional view showing in detail a portion of the tension member in the system of FIG. 1.

FIG. 2A is a side elevational view of a portion of the tension member in the system of FIG. 1.

FIG. 7 is a front sectional view of a modified form of actuation system according to this invention.

FIG. 8 is a sectional view of an automatic sprinkler which may be actuated by the actuation system of this invention.

FIG. 9 is a perspective view of a duct which includes a normally open damper which may be closed quickly by the actuation system of this invention.

Figure 1:
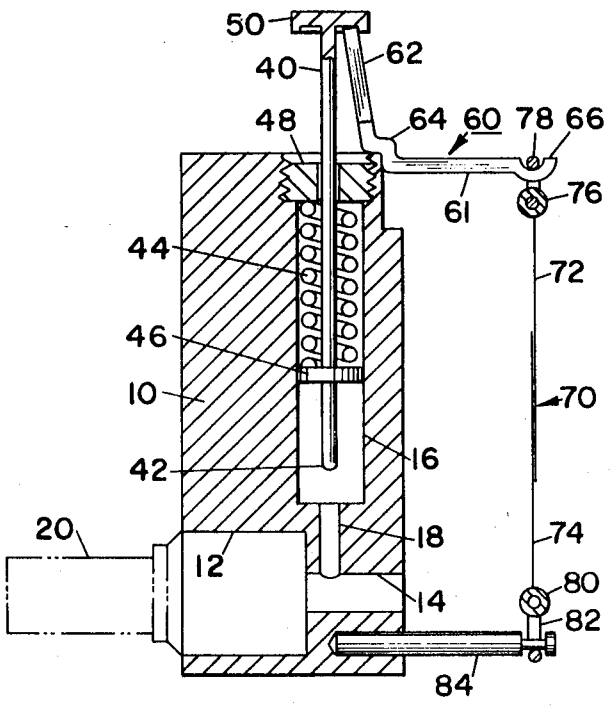
FIG. 1 is a front sectional view of the actuation system of this invention, shown prior to actuation.

Referring now to FIG. 1, 10 is a body, which may be either a cylinder or a rectangular solid, having a horizontal bore 14 and counterbore 12 near the bottom thereof. Bore 14 and counterbore 12 are coaxial. Body 10 also has an off-center vertical bore 18 and counterbore 16, which are coaxial. Bore 18 intersects bore 14.

The actuation system of this invention includes a fast-acting actuator, here illustrated as a percussion initiated radially expandable explosive actuator 20. This actuator will be simply referred to hereafter as a radial actuator. Radial actuator 20 is inserted into counterbore 12 and bore 14 so that the output end of the actuator protrudes from body 10, as shown by the phantom lines in FIG. 1. Details of the radial actuator will be described with reference to FIG. 4.

Figure 4:
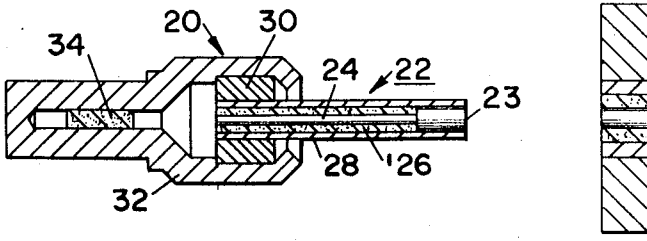
FIG. 4 is a sectional view of radial actuator according to this invention.
Figure 5:
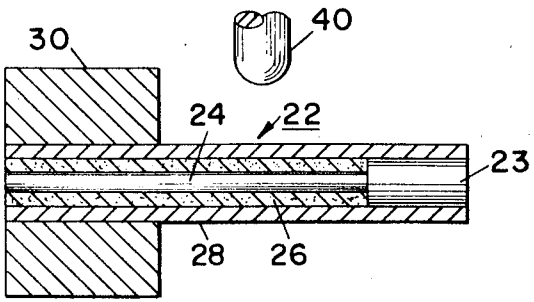
FIG. 5 is an enlarged sectional view of a portion of the radial actuator of FIG. 4 before firing.

Referring now to FIGS. 4 and 5, the radial actuator 20 of this invention has an input end 22 comprising an end plug 23 at one end thereof, a thin elongated anvil 24 extending from end plug 23, an annular charge 26 of a percussion sensitive explosive material surrounding the stem 24: a thin ductile metal tube or casing 28 surrounding the explosive charge 26 and plug 23, and a ring-shaped header 30. End plug 23 closes the end of tube 28. Casing 28 provides a striking surface for a percussion member such as firing pin 40. End plug 23, anvil 24 and tube 28 are all metallic, e.g., stainless steel. End plug 23 may be of type 303 stainless steel, and anvil 24 and tube 28 may be of annealed type 304 stainless steel. End plug 23 is silver soldered to anvil 24 and tube 28. Tube 28 is silver soldered to header 30. The input end of radial actuator 20 is inserted into bore 14 so that the outer ends of end plug 23 and tube 28 extend approximately to the outer wall of body 10.

A suitable material for explosive charge 26 is 78 percent by weight of NOL-130, which is a primary explosive composition, and 22 percent by weight of a liquid binder. NOL-130 consists of 40 percent of basic lead styphnate, 5 percent of tetrazene, 15 percent of antimony sulfide, 20 percent of barium nitrate, and 20 percent of dextrinated lead azide, all percentages being by weight. The binder consists, in percentage by weight, of 8 percent of ethyl cellulose and 92 percent of pine oil.

The output end of radial actuator 20 has a ductile generally cylindrical hollow metal body or casing 32 having a larger diameter portion which forms the center portion of radial actuator 20, and a forward portion of smaller diameter which terminates in a closed end. The smaller diameter portion of casing 32 contains an output explosive charge 34, which may be lead azide. The larger end of casing 32 is open but is crimped to hold header 30 in place. As shown in FIG. 4, the larger diameter portion of casing 32 surrounds header 30 and the inner ends of anvil 24 and tube 28.

Figure 6:
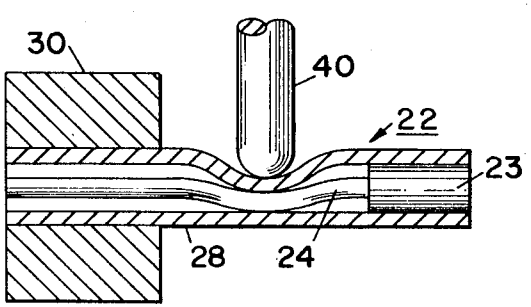
FIG. 6 is an enlarged sectional view of a portion of the radial actuator of FIG. 4 after firing.

The radial actuator 20 is percussion initiated, but differs from the usual percussion initiated explosive or pyrotechnic device in that it is initiated by a lateral rather than an axial blow. Thus, the radial initiator 20 of this invention is initiated by being struck from the side, as for example by firing pin 40 as shown in FIG. 6. When the input portion 22 of radial actuator 20 is struck, tube 28 and anvil 24 are dented as shown in FIG. 6, and explosive charge 26 is detonated. This in turn detonates the output explosive charge 34, which causes the smaller diameter portion of casing 32 to expand radially outwardly without rupturing. This radial expansion actuates an emergency device by releasing a quick release component of the device, as will be more fully described with reference to FIGS. 8 and 9. The useful work output which the actuater 20 delivers on radial expansion is far in excess of the work input received from firing pin 40.

Radial actuator 20 of this invention is a novel explosive or pyrotechnic device. The structure of the output end of the actuator, comprising casing 32 and output explosive charge 34, is similar to structures of radial actuators which are already known.

A normally retracted percussion member, here shown as a spring loaded firing pin 40, initiates actuator 20 when released. The firing pin assembly includes firing pin 40 having a striking surface 42 at the front end thereof, a compression spring 44 surrounding the firing pin, and a collar 46 on firing pin 40, all of which are disposed inside vertical counterbore 16. An adjustable nut 48 closes bore 12. Compression spring 44 is disposed between collar 46 and adjusting nut 48, and the compression of this spring may be varied by adjusting the position of adjusting nut 48. A collar 50, which is either attached to or integral with firing pin 40, is provided at the upper end of the firing pin outside body 10.

A retaining member or keeper 60 provides a mechanical linkage between a thermally responsive tension member 70 (to be described later) and firing pin 40. Essentially, keeper 60 is a lever which provides a mechanical advantage so that a small force exerted by the tension member will exert a larger force on firing pin 40. Keeper 60 has a longer lever arm 61 which engages the tension member 70, and a shorter lever arm 62 which engages collar 50. Keeper 60 pivots about fulcrum 64. The portion of keeper 60 adjacent to fulcrum 64 has a W-shaped configuration. Fulcrum 64 rests on a straight upper edge of body 10. The end 66 of lever arm 61 is curled into an essentially semicircular configuration to facilitate engagement of the tension member 70.

Tension member or fusible link 70 comprises a pair of overlapping thin strips 72 and 74 which are joined together by a thin layer of fusible material 75 (shown in FIG. 1A) to form a lap joint of low mass and high surface-to-volume ratio. Strips 72 and 74 are preferably of a metal or alloy such as copper, stainless steel, aluminum or brass. Metals and alloys are preferred over nonmetallic materials because as a rule they have both greater heat conductivity and greater strength than nonmetallic materials of the same dimensions. The fusible material is a low-melting alloy, e.g., a solder, whose composition is chosen to give the desired melting point. For example, a suitable alloy composition for most residential and commercial installations is an alloy consisting essentially of 50 percent by weight of bismuth, 26.7 percent by weight of lead, 13.3 percent by weight of tin, and 10 percent by weight of cadmium. The melting point of this alloy is 158° F. (70° C.). An alloy having a higher melting point would be used in installations where elevated temperatures, e.g., temperatures above 100° F. (38° C.) may be encountered under normal circumstances. Such installations include certain industrial installations (foundries, for example) and installations in which the sprinklers are exposed to sunlight or are located under a metal or tile roof. Suitable fusible alloy compositions are known in the art.

Figure 2:
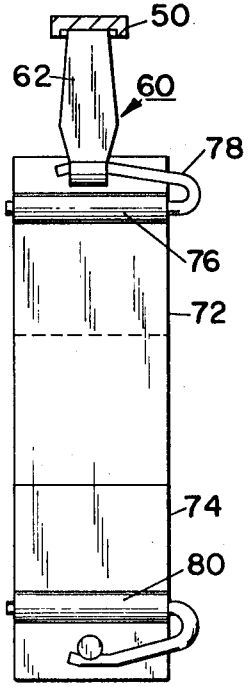
FIG. 2 is a side elevational view of the actuation system of FIG. 1.

The ends of the strips 72 and 74 remote from the lap joint are curled into cylindrical shape, as shown at 76 and 80, respectively. An essentially U-shaped rod 78 engages keeper 60 and the cylindrical portion 76 of link 72, as best seen in FIGS. 1 and 2. Similarly, a U-shaped rod 82 engages cylindrical portion 80 of link 74 and bolt 84, one end of which is anchored in body 10. The opposite end of bolt 84 has a portion of reduced diameter for engaging rod 82.

It is important for the lap joint of tension member 70 to have both a low mass and a high surface to volume ratio in order to assure rapid response once the predetermined melting temperature of the fusible alloy 75 has been reached. Both low mass and high surface to volume ratio are achieved by making strips 72, 74 and layer of fusible material 75 as thin as possible. Referring now to FIGS. 1A and 2A, 1 is the length of the lap joint, w is the width of strips 72 and 74 (which have the same width), and t is the combined thickness of strips 72, 74 and fusible layer 75. The surface area, volume, and surface to volume ratio of the lap joint can then be expressed by the following equations (1), (2) and (3):

$$A=2\,lw+2\,lt+2\,wt \quad (1)$$

$$V=lwt \quad (2)$$

$$A/V=2/t+2/w+2/l \quad (3)$$

Since the last two terms on the right hand side of equations (1) and (3) are so small compared to the first term that they can be neglected, the area and surface-to-volume ratio of the lap joint can be expressed by equations (4) and (5), respectively, as follows:

$$A=2\,lw \quad (4)$$

$$A/V=2/t \quad (5)$$

As shown by equation (5), the surface-to-volume ratio of the lap joint is inversely proportional to its thickness and is virtually independent of its length or width.

A physically strong fusible link 70 is not required. The fusible link 70 must be strong enough to withstand the tension placed on it by spring loaded firing pin 40. However, since the force required for firing pin 40 to initiate radial actuator 20 is quite small compared to the force required to hold back water under pressure in a standard automatic sprinkler, such as that shown in FIG. 17-3G of *Fire Protection Handbook* cited supra, a much weaker fusible link can be used in the present actuation system than in a standard automatic sprinkler. A much lower mass and therefore much more rapidly responsive fusible link is therefore possible in the system of the present invention.

Various modifications can be made in the components of the present system without departing from the invention. A few such modifications will be cited by way of example.

FIG. 7 shows an alternative form of lever mechanism linking the tension member 70 with the firing pin 40. In FIG. 7, 90 is a lever which pivots about fulcrum 92, which is journaled in a pair of ears 94 (only one of which shows in FIG. 7) attached to the sides of body 10. Lever 90 has a longer lever arm 95 which engages fusible link 70 through rod 78 (this linkage is similar to that shown in FIG. 1), and the shorter lever arm 96 engages the underside of collar 50. A notch 98 in lever 90 receives rod 78.

Other percussion members can be substituted for the firing pin 40 shown herein. Generally the percussion member will be spring loaded, since a spring is a convenient device for storing energy.

The actuator 20 may be replaced by other forms of actuators, which may be either pyrotechnic or otherwise. Major advantages of pyrotechnic or explosive actuators is that they are fast acting and capable of delivering output energy far in excess of the input energy which initiates their action. A pyrotechnic or explosive actuator need not be of the exact form shown. For example, a percussion-initiated radial actuator which is initiated by an axial blow at the input end rather than by a lateral blow as shown in the drawings, may be used. The radial actuator shown herein is preferred, however, because it is self-contained, that is, the casing does not rupture when the actuator functions. In contrast, conventional percussionfired explosive devices which are initiated by an axial blow, such as a conventional percussion primer or stab detonator, are prone to rupture and fragment when they function.

The actuation system of the present invention may be used for the rapid actuation of various devices. It is particularly useful for actuation of automatic sprinklers, such as that shown in FIG. 8.

Turning now to FIG. 8, 100 is an automatic sprinkler which includes a hollow body 102 providing a normally closed outlet 104 for discharging water or other fluid under pressure in case of emergency. The discharge opening of outlet 104 is closed by valve 106. Sprinkler 100 also includes a deflector 108, which may be mounted on an externally screw threaded stem journaled in internally screw threaded guideway 110. The automatic sprinkler described so far may be of known type, and certain details have been omitted.

Valve 106 is held in its normally closed position by compression member 112. This compression member 112 includes upper and lower sections 114 and 116, respectively. Sections 114 and 116, which have opposed planar mating surfaces, are joined together by means of a thin layer of bonding material, e.g., solder or brazing material. This material is sufficiently strong to hold compression member 112 together and keep discharge valve closed under normal conditions, but not strong enough to withstand the radial expansion of radial actuator 20 when fired. A cylindrical opening 118 for insertion of radial actuator 20 is provided between sections 114 and 116. The axis of cylindrical opening 118 lies in the mating plane of surfaces 114 and 116. Opening 118 extends inwardly from at least one exterior surface of compression member 112, and may extend from one side to the other of compression member 112. When a radial actuator 20 is inserted into opening 118 and is initiated, expansion of the casing 32 of radial actuator 20 forces sections 114 and 116 apart, breaking the adhesive bond between these two sections. This releases the compressive force that holds valve 106 in place. Water under pressure may then be discharged through outlet 104. Water being discharged from outlet 104 is deflected by deflector 108.

The compression member 112 illustrated in FIG. 8 is merely one form of compression member which may be used to keep the automatic sprinkler closed under normal conditions. It will be understood that different forms of compression member may be used, the main requirements being that the compression member must be strong enough to withstand the water pressure in the automatic sprinkler until actuated and must be capable of being released rapidly when actuated by a suitable actuator such as a radial actuator 20 illustrated herein.

Another type of emergency device which may be actuated by the actuation system of this invention is a fire damper in a heating or air conditioning duct, as shown in FIG. 9. In FIG. 9, 120 is a fire damper which is normally held open by a chain, the ends of which are tied to frangible link 122 so that the chain is under tension. This arrangement is more fully illustrated and described in a data sheet entitled "Frangible Link—Installation—Replacement", published by ICI United States Inc. (now ICI Americas Inc.) Atlas Aerospace Division, Valley Forge, Pa. The frangible link 122 is notched at the center and has a central opening 124 for insertion of a radial actuator as shown in the data sheet. In accordance with the present invention, a percussion-initiated radial actuator 20 is substituted for the electrically initiated radial actuator shown in the data sheet. Expansion of radial actuator 20 fractures frangible link 122, releasing fire damper 120 so that it closes.

The actuation system of this invention can also be used to actuate other types of devices requiring fast action, especially other types of emergency devices.

Figure 3:
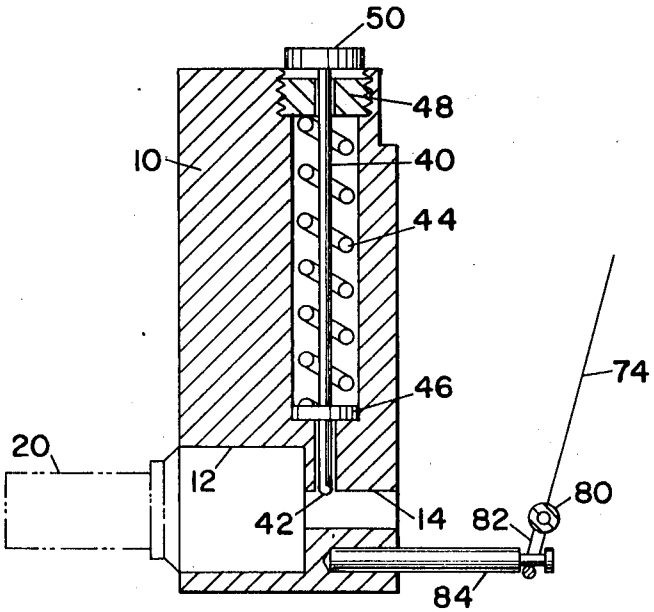
FIG. 3 is a front sectional view of the actuation system of FIG. 1 after actuation, with portions of the system omitted.

By way of specific example, a preferred tension member 70, suitable for use in an actuation system for an automatic sprinkler such as that shown in FIG. 8, comprises a pair of copper strips 72 and 74, each 0.5 inch wide and 1 mil (0.001 inch or 0.0025 cm) thick, and a fusible layer 75 which is 4 mils (0.004 inch or 0.010 cm) thick, giving a total joint thickness t of 6 mils (0.006 inch or 0.015 cm). The fusible material in this case may be the previously described alloy consisting essentially of 50 percent bismuth, 26.7 percent lead, 13.3 percent tin, and 10 percent cadmium, all percentages being by weight, and having a melting point of 158° F. (70° C.). This joint has a surface-to-volume (A/V) ratio of 345 reciprocal inches (345 $inch^{-1}$). This link has an RTI of approximately 5. Other suitable joints may utilize thicker strips 72 and 74, and may have A/V ratios as low as 100 $inch^{-1}$, although preferably the A/V ratio is at least 150 $inch^{-1}$ and more preferably at least 200 $inch^{-1}$. An example of such other joint according to this invention is one having a pair of copper strips 72 and 74, each 0.5 inch wide and 2 mils (0.002 inch or 0.005 cm) thick and a fusible layer 4 mils thick, has a total joint thickness t of 8 mils (0.008 inch or 0.02 cm) thick and a surface-to-volume (A/V) ratio of 262 $inch^{-1}$. By comparison, a commercially available automatic sprinkler, substantially as shown in FIG. 17-3G of *Fire Protection Handbook* cited supra, has a pair of metal strips each about 0.015 inch (0.038 cm) thick and a solder layer about 0.003 inch (0.008 cm) thick, giving a total joint thickness of about 0.033 inch (0.084 cm) and an A/V ratio of 72.1.

Also by way of specific example, a preferred radial actuator 20 comprises an end plug 23 of type 303 stainless steel 0.040 inch (0.10 cm) in diameter, an anvil 24 of type 304 stainless steel 0.0185 inch (0.045 cm) in diameter, and a tube 28 of type 304 stainless steel having an inside diameter of 0.040 inch (0.10 cm). The annulus containing explosive charge 26 is 0.15 inch (0.37 cm) long, and the primary explosive charge 26 has the composition previously indicated, i.e., 78 percent by weight of NOL-130 and 22 percent by weight of a liquid binder consisting of 8 parts by weight of ethyl cellulose and 92 parts by weight of pine oil. The larger diameter portion of casing 32 may have an outside diameter of $\frac{1}{4}$ to $\frac{1}{2}$ inch, and the smaller diameter portion may have a correspondingly smaller outside diameter, e.g., 3/16 to 5/16 inch.

The response time of an actuation system of this invention, having a fusible link and a radial actuator as described above, was tested by placing the fusible link in a hot air stream having a temperature of 219° F. (104° C.) and a velocity of 3.5 meters per second. The response time was about 2 seconds. Two commercially available residential sprinklers of the same make and model, when tested under the same conditions, had response times of 29 and 39 seconds.

Actual response times in any given installation will not correspond to those in the test reported here, because actual response time is affected by such parameters as ceiling height, height at which the sprinklers are installed, air velocity, and distance from the fire to the sprinkler. However, comparative response times are of value in measuring the comparative speeds with which to sprinkler actuation mechanism will respond in a given situation.

The actuation system of this invention is nonelectrical. This is a major advantage, because electrical actuation systems for automatic sprinklers and other emergency devices have met considerable resistance. This is probably due to the fact that electrical systems are regarded as unreliable in an emergency: systems which depend on an external power supply would not operate in the event of power failure, which is a frequent occurrence during fires, and battery powered systems may fail to operate because the batteries have not been periodically checked and replaced.

A major advantage of the actuation system of this invention is its very fast response time. Fast reponse time is due to the use of a low mass, high surface-to-volume fusible link as already explained. The low mass fusible link is made possible by providing an actuator, a percussion element and a fusible link as separate components and placing the percussion element and actuator between the fusible link and the device to be actuated. The fusible link of this invention can be of low mass and correspondingly low strength, since it needs to be only strong enough to hold a percussion element (such as firing pin 40) in place. The fusible link in a conventional automatic sprinkler must be much stronger and therefore more massive and slower, because it directly holds the sprinkler's lever mechanism in place against the considerable force exerted by high pressure water. The present actuation system therefore solves the problem of slow response time, which is a major problem in present day conventional automatic sprinklers.

What is claimed is:

1. An actuation system comprising:

(a) a percussion-initiated radially expandable actuator having a percussion-initiated explosive input charge, an explosive output charge and a casing, at least a portion of which expands radially outwardly when sid output charge is fired;

(b) a normally retracted percussion member which when released initiates said actuator; and (c) a thermally responsive fusible link having a thin layer of fusible material for controlling the release of said percussion member.

2. An actuation system according to claim 1 wherein said input charge is encased in a ductile thin-walled tubular casing, said tubular casing providing a striking surface for the percussion member.

3. An actuation system of claim 1 in which said thermally responsive fusible link consists essentially of overlapping thin strips held together by a thin layer of fusible material to form a lap joint having a surface-to-volume ratio of at least 100 $inch^{-1}$.

* * * * *